US011824296B2

(12) United States Patent
Nozaki

(10) Patent No.: US 11,824,296 B2
(45) Date of Patent: Nov. 21, 2023

(54) TERMINAL, CONNECTOR AND CONNECTOR ASSEMBLY

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Shinji Nozaki, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 156 days.

(21) Appl. No.: 17/437,536

(22) PCT Filed: Dec. 18, 2019

(86) PCT No.: PCT/JP2019/049612
§ 371 (c)(1),
(2) Date: Sep. 9, 2021

(87) PCT Pub. No.: WO2020/183847
PCT Pub. Date: Sep. 17, 2020

(65) Prior Publication Data

US 2022/0158376 A1 May 19, 2022

(30) Foreign Application Priority Data

Mar. 12, 2019 (JP) ..... 2019-044608

(51) Int. Cl.
*H01R 13/00* (2006.01)
*H01R 13/11* (2006.01)
*H01R 13/428* (2006.01)

(52) U.S. Cl.
CPC ..... *H01R 13/11* (2013.01); *H01R 13/428* (2013.01)

(58) Field of Classification Search
CPC ..... H01R 13/11; H01R 13/10; H01R 13/08; H01R 13/02; H01R 13/00; H01R 13/428;
(Continued)

(56) References Cited

U.S. PATENT DOCUMENTS 4,838,816 A * 6/1989 Matsusaka ..... H01R 13/187 439/852
5,611,716 A 3/1997 Egenolf
(Continued)

FOREIGN PATENT DOCUMENTS

JP 105-089927 A 4/1993
JP 109-129317 A 5/1997
JP 2005-158453 A 6/2005

OTHER PUBLICATIONS

International Search Report dated Feb. 25, 2020 for WO 2020/183847 A1 (4 pages).

*Primary Examiner* — Harshad C Patel
(74) *Attorney, Agent, or Firm* — Venjuris, P.C.

(57) ABSTRACT

A terminal includes a tube portion 33, into which a mating terminal is inserted, and a resiliently deformable resilient piece 34 disposed in the tube portion 33. The resilient piece 34 includes an inner contact point 37 located inside the tube portion 33 to contact the mating terminal, and an outer contact point 40 located outside the tube portion 33 to contact a conductor different from the mating terminal.

7 Claims, 12 Drawing Sheets

(58) Field of Classification Search
CPC .. H01R 13/426; H01R 13/24; H01R 13/2464; H01R 13/4364
See application file for complete search history.

(56) References Cited

U.S. PATENT DOCUMENTS

| | | | | | |
|---|---|---|---|---|---|
| 5,795,170 | A * | 8/1998 | Okabe | H01R 13/5216 | 439/252 |
| 6,139,376 | A * | 10/2000 | Ooya | H01R 13/187 | 439/948 |
| 6,394,858 | B1 * | 5/2002 | Geltsch | H01R 13/114 | 439/852 |
| 7,264,518 | B2 * | 9/2007 | Ellis | H01R 13/114 | 439/948 |
| 7,465,199 | B2 * | 12/2008 | Osada | H01R 4/185 | 439/852 |
| 7,470,159 | B2 * | 12/2008 | Hara | H01R 13/113 | 439/852 |
| 7,955,104 | B1 * | 6/2011 | Wicks | H01R 13/7032 | 439/188 |
| 9,660,393 | B2 * | 5/2017 | Shinmi | H01R 13/7032 | |
| 10,122,108 | B2 * | 11/2018 | Bhagyanathan Sathianathan | H01R 13/187 | |
| 11,075,479 | B2 * | 7/2021 | Bhagyanathan Sathianathan | H01R 13/187 | |
| 11,239,595 | B2 * | 2/2022 | Sugimoto | H01R 13/11 | |
| 2014/0287634 | A1 * | 9/2014 | Tsuji | H01R 13/113 | 439/852 |

* cited by examiner

TERMINAL, CONNECTOR AND CONNECTOR ASSEMBLY

CROSS REFERENCE TO RELATED APPLICATIONS

This application is a national phase of PCT application No. PCT/JP2019/049612, filed on 18 Dec. 2019, which claims priority from Japanese patent application No. 2019-044608, filed on 12 Mar. 2019, all of which are incorporated herein by reference.

TECHNICAL FIELD

The present disclosure relates to a terminal, a connector and a connector assembly.

BACKGROUND

A connector with shorting terminal is known from Japanese Patent Laid-Open Publication No. 2015-056369. This connector with shorting terminal includes a connector housing having a plurality of terminal accommodation chambers capable of accommodating a plurality of terminals and a shorting terminal for short-circuiting two terminals by being mounted into at least one terminal accommodation chamber and contacting at least two of the accommodated terminals.

When the connector with shorting terminal is connected to a mating connector housing, a short-circuit releasing member provided in the mating connector housing contacts the shorting terminal to deform the shorting terminal, whereby a short-circuit state is released.

PRIOR ART DOCUMENT

Patent Document

Patent Document 1: JP 2015-056369 A

SUMMARY OF THE INVENTION

Problems to be Solved

According to the conventional art, there is a problem of increasing the number of components since the shorting terminal is separately necessary to short-circuit two terminals.

The present disclosure was completed on the basis of the above situation and aims to reduce the number of components for a technique for short-circuiting terminals.

Means to Solve the Problem

The present disclosure is directed to a terminal with a tube portion, a mating terminal being inserted into the tube portion, and a resiliently deformable resilient piece disposed in the tube portion, wherein the resilient piece includes an inner contact point located inside the tube portion to contact the mating terminal, and an outer contact point located outside the tube portion to contact a conductor different from the mating terminal.

Effect of the Invention

According to the present disclosure, it is possible to reduce the number of components for a technique for short-circuiting terminals.

DETAILED DESCRIPTION TO EXECUTE THE INVENTION

Description of Embodiments of Present Disclosure

Figure 1:
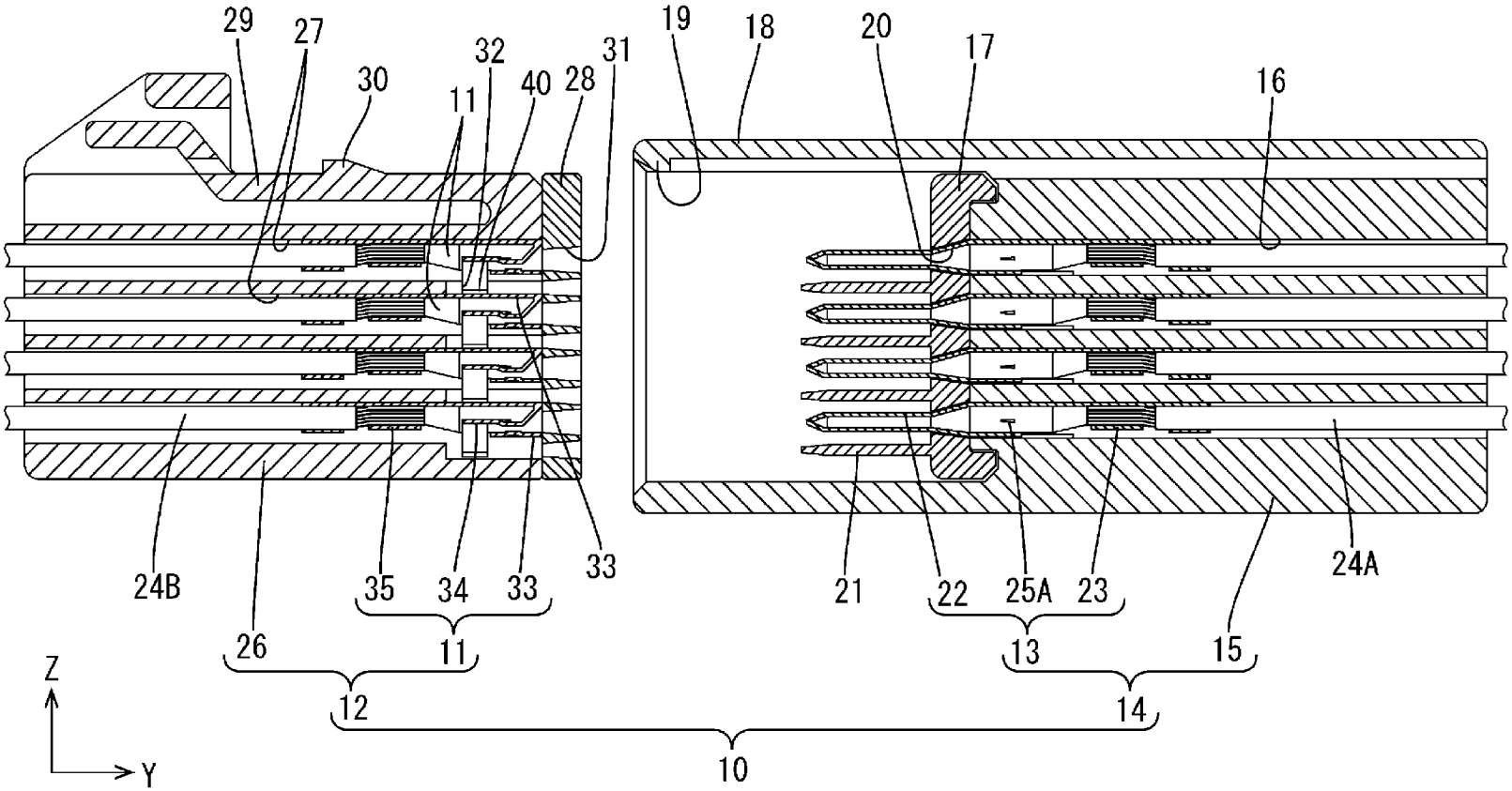
FIG. 1 is a section showing a state before a male connector and a female connector according to a first embodiment are connected.

First, embodiments of the present disclosure are listed and described.

(1) The terminal of the present invention includes a tube portion, a mating terminal being inserted into the tube portion, and a resiliently deformable resilient piece disposed in the tube portion, wherein the resilient piece includes an inner contact point located inside the tube portion to contact the mating terminal, and an outer contact point located outside the tube portion to contact a conductor different from the mating terminal.

Since the terminal can be electrically connected to the adjacent other terminal by the outer contact point, a shorting member is unnecessary. In this way, the number of components can be reduced.

(2) Preferably, the resilient piece includes a detour portion to be located lateral to the mating terminal with the mating terminal inserted in the tube portion.

An external region can be led to the outside of the tube portion while the interference of the resilient piece and the mating terminal is suppressed by the detour portion.

(3) Preferably, the detour portions are disposed on both sides of the mating terminal inserted in the tube portion.

Since the detour portions are located on the both sides of the mating terminal, a load applied to the inner contact point and a load applied to the outer contact point can be equally received by the detour portions on both sides of the mating terminal. In this way, the electrical connection reliability of the inner contact point and the outer contact point is improved.

The connector of the present disclosure includes the above terminal, and a housing having a plurality of accommodating portions for accommodating the terminal, wherein the plurality of accommodating portions are disposed side by side and window portions allowing communication between adjacent ones of the plurality of accommodating portions penetrate through the plurality of accommodating portions, a part of the resilient piece including the outer contact point penetrates through the window portion with the terminal accommodated in each of the plurality of accommodating portions, and one terminal and another terminal adjacent to the one terminal are electrically connected by the outer contact point of the one terminal, out of a plurality of the terminals.

Since the adjacent terminals are electrically connected to each other by the outer contact point penetrating through the window portion, a shorting terminal is unnecessary, the connector can be reduced in size and the manufacturing cost of the connector can be reduced. Further, since it is not necessary to deform the shorting terminal, a connection force of the connector and the mating connector can be reduced.

(5) Preferably, the terminal includes a metal locking lance projecting toward the accommodating portion to be engaged with the accommodating portion.

Since the accommodating portion includes the window portion, there are possibly structural constraints in the case of providing a structure (e.g. locking lance) for holding the terminal. Since the accommodating portion needs not be provided with a special structure for holding the terminal by the terminal including the metal locking lance, a degree of freedom in designing the connector is improved.

(6) The connector assembly of the present disclosure includes the above connector, and a mating connector to be connected to the connector, wherein the mating terminal is accommodated in the mating connector, and the mating terminal releases electrical connection between the one terminal and the other terminal adjacent to the one terminal by contacting the inner contact point of the resilient piece to deform the resilient piece with the connector and the mating connector connected.

Since electrical connection between the adjacent terminals is released by the contact of the mating terminal with the inner contact point of the terminal, the number of components of the connector assembly can be reduced as compared to the case where a releasing member is separately provided.

(7) Preferably, the mating connector includes an insulating portion having an insulating property and to be interposed between the outer contact point of the one terminal and the other terminal adjacent to the one terminal with the connector and the mating connector connected.

The adjacent terminals can be reliably insulated from each other by the insulating portion with the connector and the mating connector connected.

Details of Embodiment of Present Disclosure

Hereinafter, embodiments of the present disclosure are described. The present invention is not limited to these illustrations and is intended to be represented by claims and include all changes in the scope of claims and in the meaning and scope of equivalents.

First Embodiment

A connector assembly 10 according to a first embodiment of the present disclosure is described with reference to FIGS. 1 to 8. In the following description, a Z direction is an upward direction, a Y direction is a forward direction and an X direction is a leftward direction. Note that, for a plurality of identical members, some may be denoted by a reference sign and others may not be denoted by the reference sign.

[Connector Assembly 10]

As shown in FIG. 1, the connector assembly 10 includes a female connector 12 (an example of a connector) having female terminals 11 (an example of a terminal) and a male connector 14 (an example of a mating connector) having male terminals 13 (an example of a mating terminal).

[Male Connector 14]

The male connector 14 includes a male housing 15 formed by injection-molding a material containing an insulating synthetic resin, and the male terminals 13 to be accommodated into the male housing 15.

The male housing 15 includes male accommodating portions 16 for accommodating the plurality of male terminals 13. The male accommodating portions 16 are arranged in a vertical direction. The male terminals 13 are inserted into the male accommodating portions 16 from front. A male front mask 17 is mounted on rear end parts of the male accommodating portions 16 and contacts the male terminals 13 from behind, thereby preventing the male terminals 13 from coming out rearward. The male front mask 17 is formed by injection-molding a material containing an insulating synthetic resin.

The male housing 15 includes a receptacle 18 open rearward. A lock portion 19 projecting downward is formed on a rear end part of the upper wall of the receptacle 18. The female connector 12 is fit into the receptacle 18.

The male front mask 17 is formed with a plurality of male through holes 20 penetrating in a front-rear direction. The male through holes 20 are provided at positions corresponding to the male accommodating portions 16. The male terminals 13 are inserted in the male through holes 20. Plate-like insulating portions 21 projecting rearward are formed at positions between adjacent ones of the male through holes 20 on the rear surface of the male front mask 17.

[Male Terminals 13]

The male terminal 13 is formed by press-working a metal plate material into a predetermined shape. An arbitrary metal such as copper, copper alloy, aluminum or aluminum alloy can be selected as a metal constituting the metal plate material. A plate-like male tab 22 projecting rearward is formed in a rear end part of the male terminal 13. A male barrel 23 to be connected to a wire is formed in a front end part of the male terminal 13. The male barrel 23 is crimped to the outer periphery of a wire 24A, whereby the wire 24A and the male terminal 13 are electrically connected.

The male tab 22 projects rearward from the male through hole 20 of the male front mask 17 and is located in the receptacle 18. A rear end part of the male tab 22 projects further rearward than that of the insulating portion 21.

A metal locking lance 25A projecting laterally is formed on a side wall of the male terminal 13. The metal locking lance 25A is engaged with the inner wall of the male accommodating portion 16, whereby the male terminal 13 is held in the male accommodating portion 16 while being prevented from coming out forward.

[Female Connector 12]

As shown in FIG. 1, the female connector 12 includes a female housing 26 (an example of a housing) formed by injection-molding a material containing an insulating synthetic resin and the female terminals 11 to be accommodated into the female housing 26.

The female housing 26 includes female accommodating portions 27 (an example of accommodating portions) for accommodating the plurality of female terminals 11. The female accommodating portions 27 are arranged in the vertical direction. The female terminals 11 are inserted into the female accommodating portions 27 from behind. A female front mask 28 is mounted on front end parts of the female accommodating portions 27 and contacts the female terminals 11 from front, thereby preventing the female terminals 11 from coming out forward. The female front mask 28 is formed by injection-molding a material containing an insulating synthetic resin.

A lock arm 29, which is deflected and deformed in the vertical direction, is formed on top of the female housing 26. The lock arm 29 is cantilevered rearward from a front end part of the female housing 26. A lock claw 30 projecting upward is formed on top of the lock arm 29. By the engagement of the lock claw 30 of the female housing 26 and the lock portion 19 of the male housing 15, the female housing 26 is held in a state fit in the receptacle 18 of the male housing 15.

The female front mask 28 is formed with a plurality of female through holes 31 penetrating in the front-rear direction. The female through holes 31 are provided at positions corresponding to the female accommodating portions 27. The male tabs 22 of the male terminals 13 are inserted into the female through holes 31 from front with the female 26 and the male housing 15 connected.

Vertically penetrating window portions 32 are formed at positions near front end parts in the lower walls of the female accommodating portions 27. The female accommodating portions 27 adjacent in the vertical direction communicate through the window portions 32.

[Female Terminals 11]

Figure 2:
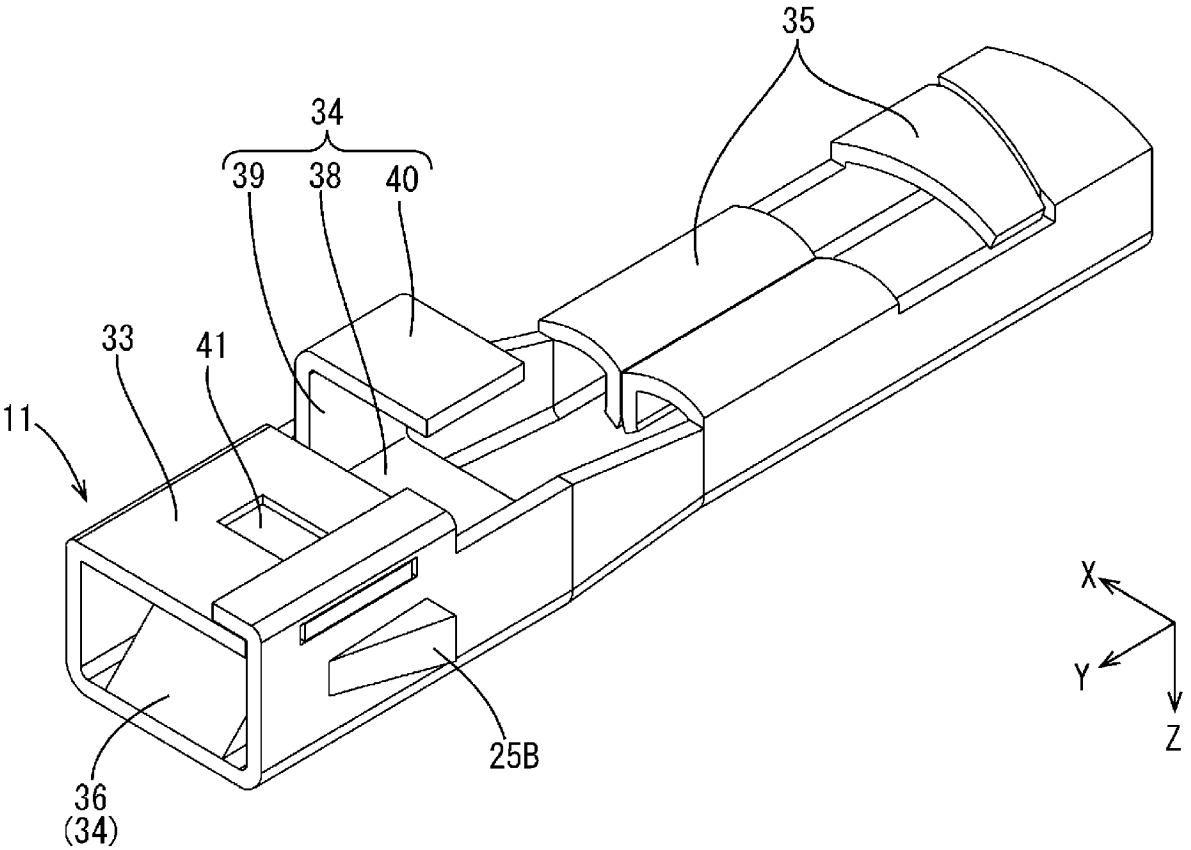
FIG. 2 is a perspective view showing a female terminal.

As shown in FIG. 2, the female terminal 11 is formed by press-working a metal plate material into a predetermined shape. An arbitrary metal such as copper, copper alloy, aluminum or aluminum alloy can be selected as a metal constituting the metal plate material. A tube portion 33, into which the male tab 22 is inserted from front, is provided in a front end part of the female terminal 11. A resiliently deformable resilient piece 34 is disposed inside the tube portion 33.

A female barrel 35 to be connected to a wire 24B is formed in a rear end part of the female terminal 11. The female barrel 35 is crimped to the outer periphery of the wire 24B, whereby the wire 24B and the female terminal 11 are electrically connected (see FIG. 1).

Figure 3:
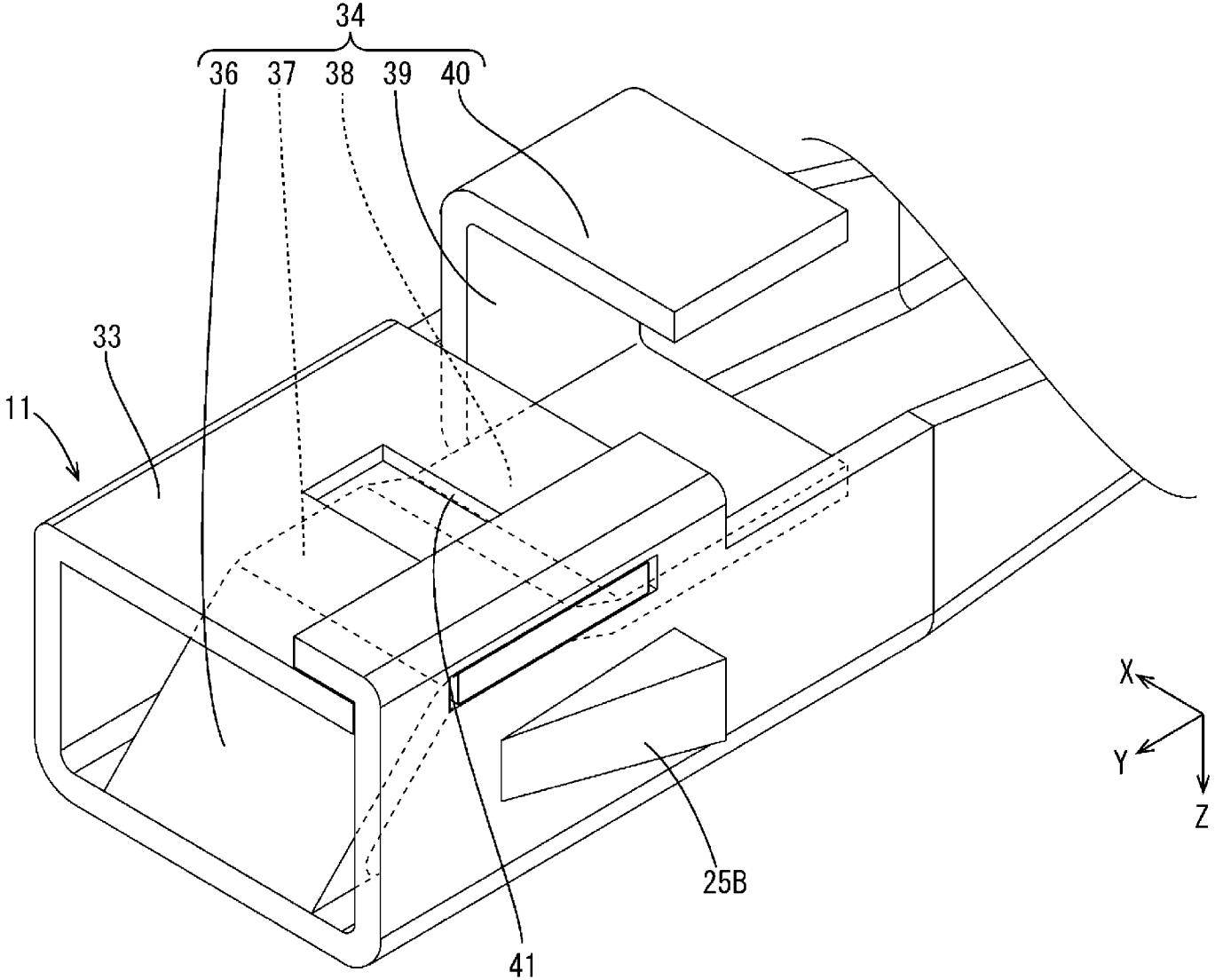
FIG. 3 is an enlarged view partially cut away showing a tube portion and a resilient piece of the female terminal.

As shown in FIG. 3, the tube portion 33 is in the form of a rectangular tube extending in the front-rear direction. The tube portion 33 is formed to be somewhat flat in the vertical direction. A metal locking lance 25B projecting laterally is formed on a side wall of the tube portion 33. The metal locking lance 25B is in the form of a triangular prism tapered toward a front side. By engaging the metal locking lance 25B with the inner wall of the female accommodating portion 27, the female terminal 11 is held in the female accommodating portion 27 while being prevented from coming out rearward.

Figure 4:
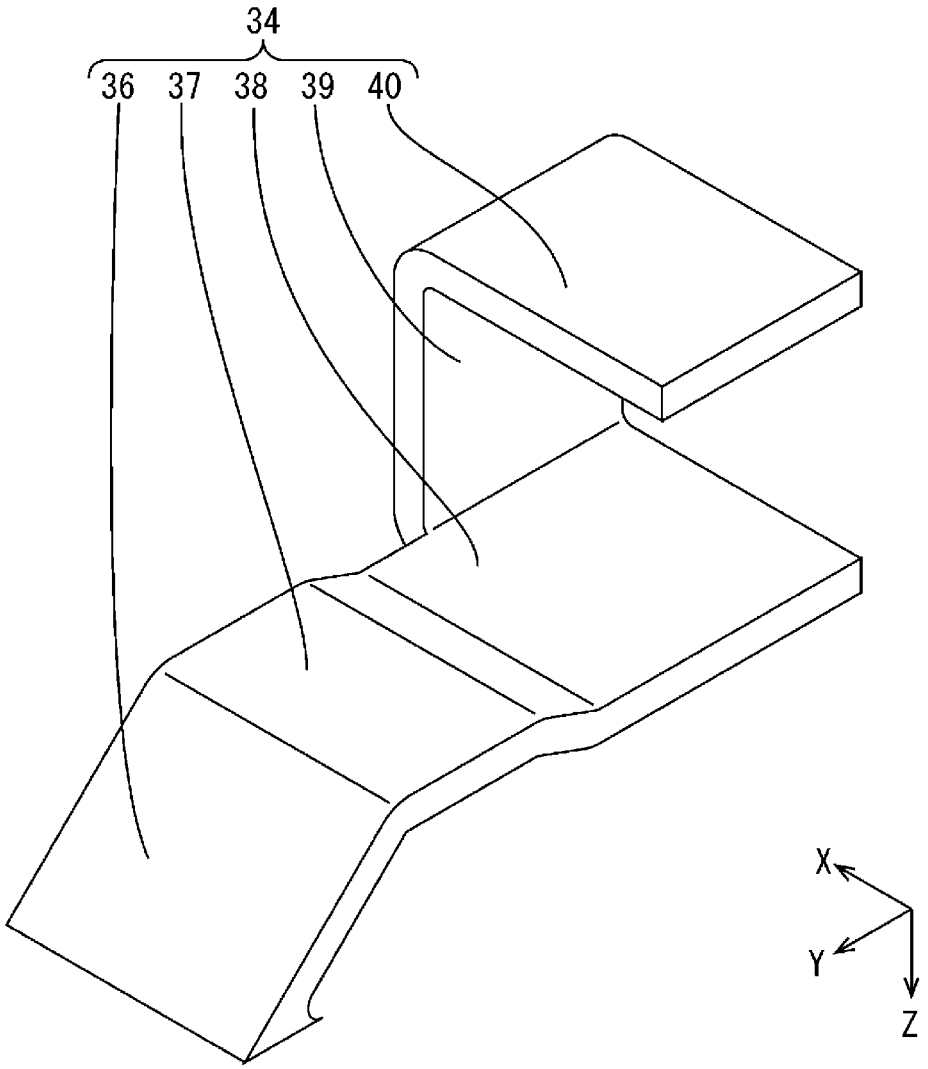
FIG. 4 is an enlarged view partially cut away showing the resilient piece.

As shown in FIGS. 3 and 4, the resilient piece 34 extends rearward from a front end part of the lower wall of the tube portion 33. The resilient piece 34 includes an inclined portion 36 obliquely extending to a lower-rear side from a front end part of the tube portion 33, an inner contact point 37 provided on the rear end of the inclined portion 36 and extending in the front-rear direction, an extending portion 38 provided somewhat above the inner contact point 37 behind the inner contact point 37 and extending in the front-rear direction, a detour portion 39 extending downward from the left side edge of the extending portion 38, and an outer contact point 40 extending rightward from the lower end of the detour portion 39.

The inner contact point 37 is located inside the tube portion 33. The detour portion 39 extends outward from the inside of the tube portion 33 and a lower end part of the detour portion 39 is located outside the tube portion 33. In this way, the outer contact point 40 is located at a position below the lower wall of the tube portion 33 and outside the tube portion 33.

The inner contact point 37 resiliently contacts the male tab 22 inserted into the tube portion 33. The inner contact point 37 contacts the upper surface of the male tab 22 and presses the male tab 22 against the lower wall of the tube portion 33. A contact protrusion 41 projecting upward is formed on the lower wall of the tube portion 33. The male tab 22 is sandwiched between the inner contact point 37 and the contact protrusion 41, thereby being electrically connected to the female terminal 11.

As shown in FIG. 1, with the female terminal 11 accommodated in the female accommodating portion 27, the detour portion 39 and the outer contact point 40 penetrate through the window portion 32 in the vertical direction.

Figure 5:
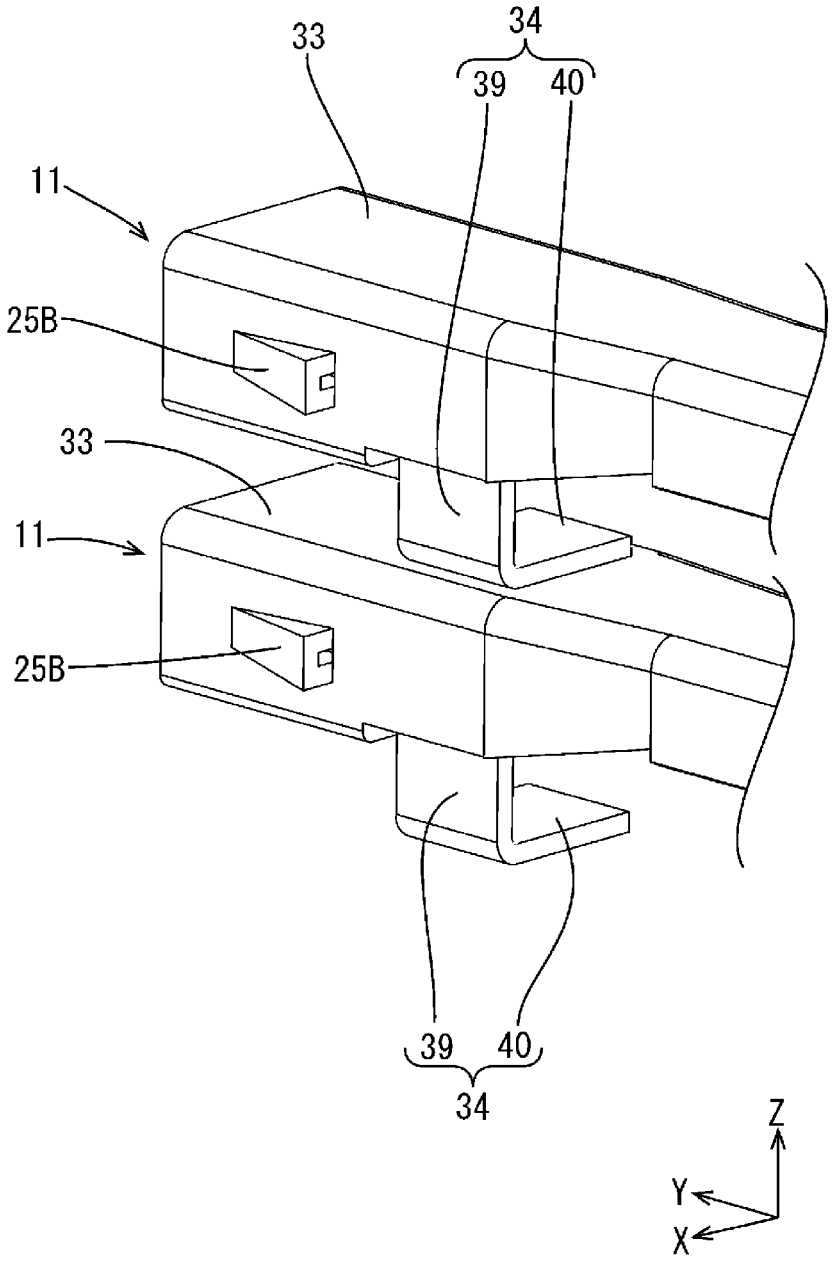
FIG. 5 is a development showing a metal plate material before being processed into the female terminal.

FIG. 5 shows an electrical connection structure of the female terminals by illustrating a pair of the female terminals 11 arranged in the vertical direction. In FIG. 5, members different from the female terminals 11 such as the female housing 26 are omitted. The detour portion 39 is led out downward from the tube portion 33 of one female terminal 11 located above. The outer contact point 40 formed on the lower end part of the detour portion 39 contacts the upper wall of the tube portion 33 of the other female terminal 11 located below the one female terminal 11 from above. In this way, the one female terminal 11 and the other female terminal 11 located below the one female terminal 11 are electrically connected via the outer contact point 40. As a result, the plurality of female terminals 11 accommodated in the female housing 26 are electrically connected (see FIG. 1).

Figure 6:
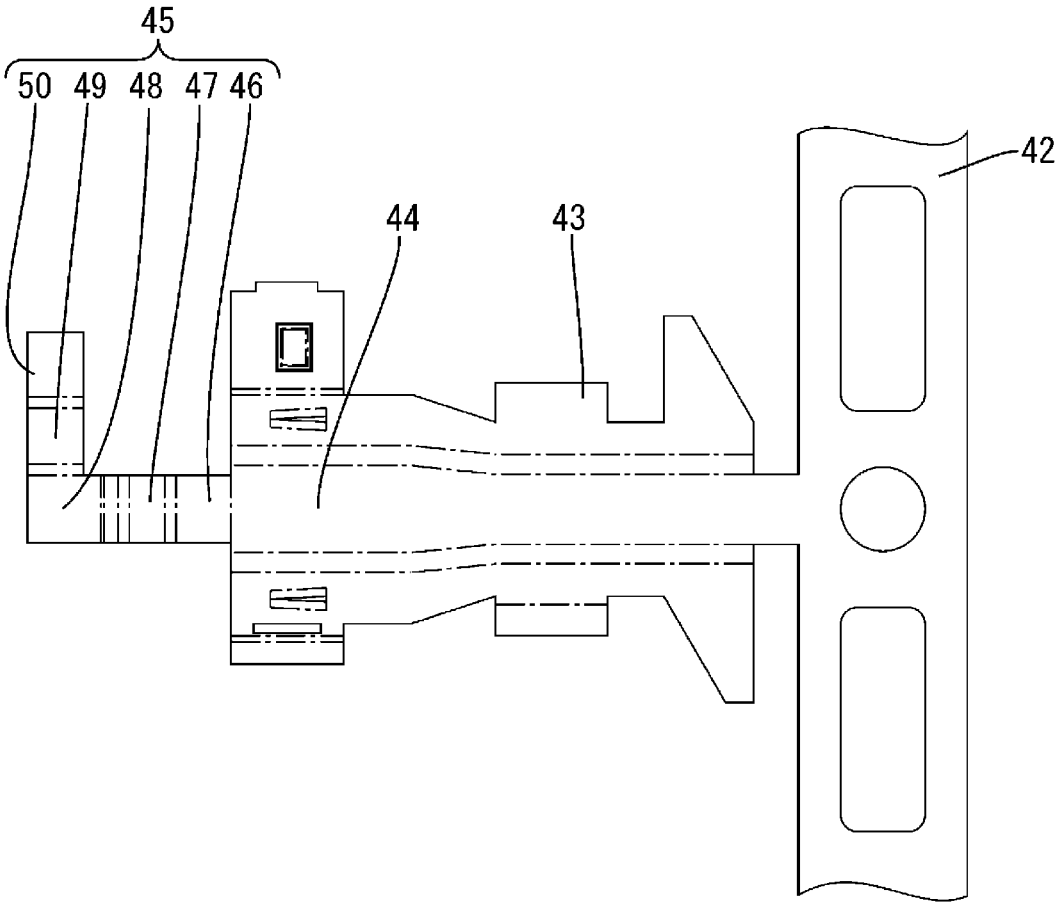
FIG. 6 is a partial enlarged perspective view showing a state where an outer contact point of the female terminal disposed on an upper side and the tube portion of the female terminal disposed on a lower are electrically connected.

As shown in FIG. 6, the female terminal 11 before being bent extends laterally (in a direction intersecting an extending direction of a carrier 42) from a side edge of the elongated carrier 42. The female terminal 11 before being bent includes a part 43 to be processed into the female barrel 35, a part 44 to be processed into the tube portion 33 and a part 45 to be processed into the resilient piece 34 in this order from the carrier 42. Dashed-dotted lines shown in FIG. 6 indicate bending lines for bending the metal plater material.

The part 45 to be processed into the resilient piece 34 is formed to extend from a tip part of the part 44 to be processed into the tube portion 33. The part 45 to be processed into the resilient piece 34 is formed with a part 46 to be processed into the inclined portion, a part 47 to be processed into the inner contact point 37 and a part 48 to be processed into the extending portion 38 in this order from the part 44 to be processed into the tube portion 33 along the direction intersecting the extending direction of the carrier 42.

A part 49 to be processed into the detour portion 39 and a part 50 to be processed into the outer contact point 40 extend along the extending direction of the carrier 42 from a side edge of the part 48 to be processed into the extending portion 38.

[Example of Assembling Process of Connector Assembly 10]

Next, an example of an assembling process of the connector assembly 10 according to this embodiment is described. The assembling process of the connector assembly 10 is not limited to the one described below.

The male terminals 13 are formed by press-working the metal plate material into the predetermined shape. The male housing 15 and the male front mask 17 are formed by injection-molding the material containing the insulating synthetic resin. The male terminal 13 connected to the wire 24A is inserted into the male accommodating portion 16 of the male housing 15 from front. By engaging the metal locking lance 25A of the male terminal 13 with the inner wall of the male accommodating portion 16, the male terminal 13 is retained in the male accommodating portion 16 not to come out forward. The male front mask 17 is assembled with the male housing 15 from behind, whereby the male terminals 13 are held in the male accommodating portions 16 while being prevented from coming out rearward. In this way, the male connector 14 is completed.

The female terminals 11 are formed by press-working the metal plate material into the predetermined shape. The female barrel 35 of the female terminal 11 is crimped to the wire 24B. The female housing 26 and the female front mask 28 are formed by injection-molding the material containing the insulating synthetic resin. The female terminal 11 connected to the wire 24B is inserted into the female accommodating portion 27 of the female housing 26 from behind. By engaging the metal locking lance 25B of the female terminal 11 with the inner wall of the female accommodating portion 27, the female terminal 11 is retained in the female accommodating portion 27 not to come out rearward. The female front mask 28 is assembled with the female housing 26 from front, whereby the female terminals 11 are held in the female accommodating portions 27 while being prevented from coming out forward. The female terminals 11 respectively accommodated in the female accommodating portions 27 arranged in the vertical direction are electrically connected via the outer contact points 40 provided on the respective female terminals 11. In this way, the male connector 12 is completed.

Subsequently, the female connector 12 is fit into the receptacle 18 of the male connector 14 from behind.

Figure 7:
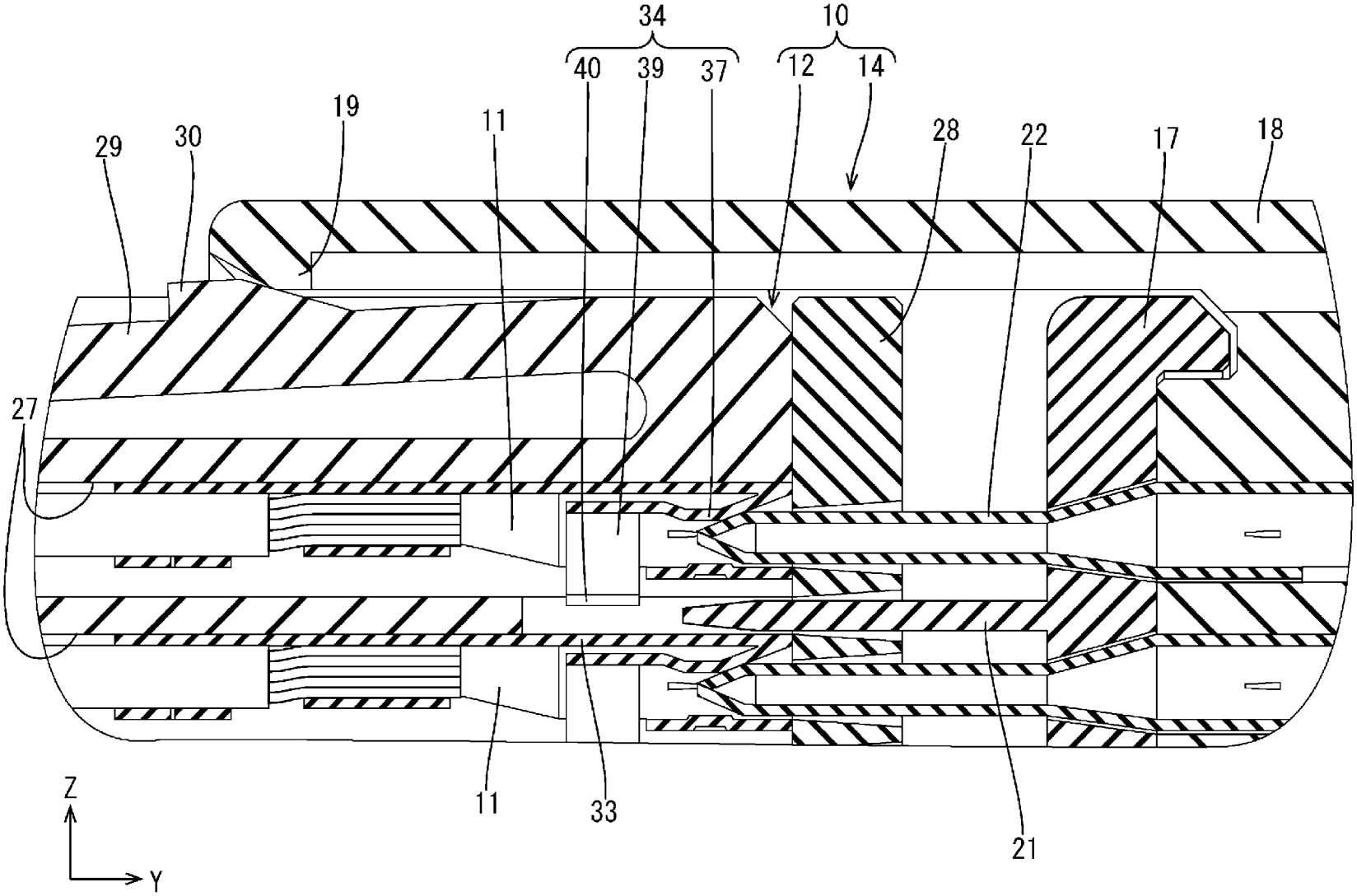
FIG. 7 is a partial enlarged section showing the process of connecting the male connector and the female connector.

As shown in FIG. 7, the male tabs 22 are inserted into the tube portions 33 from front. The male tabs 22 contact the inner contact points 37 from below. The resilient pieces 34 are resiliently deformed to move the inner contact points 37 upward. By upward movements of the outer contact points 40, electrical connection between the female terminals 11 arranged in the vertical direction is released. The lock claw 30 contacts the lock portion 19 front below, whereby the lock arm 29 is resiliently deformed downward.

Figure 8:
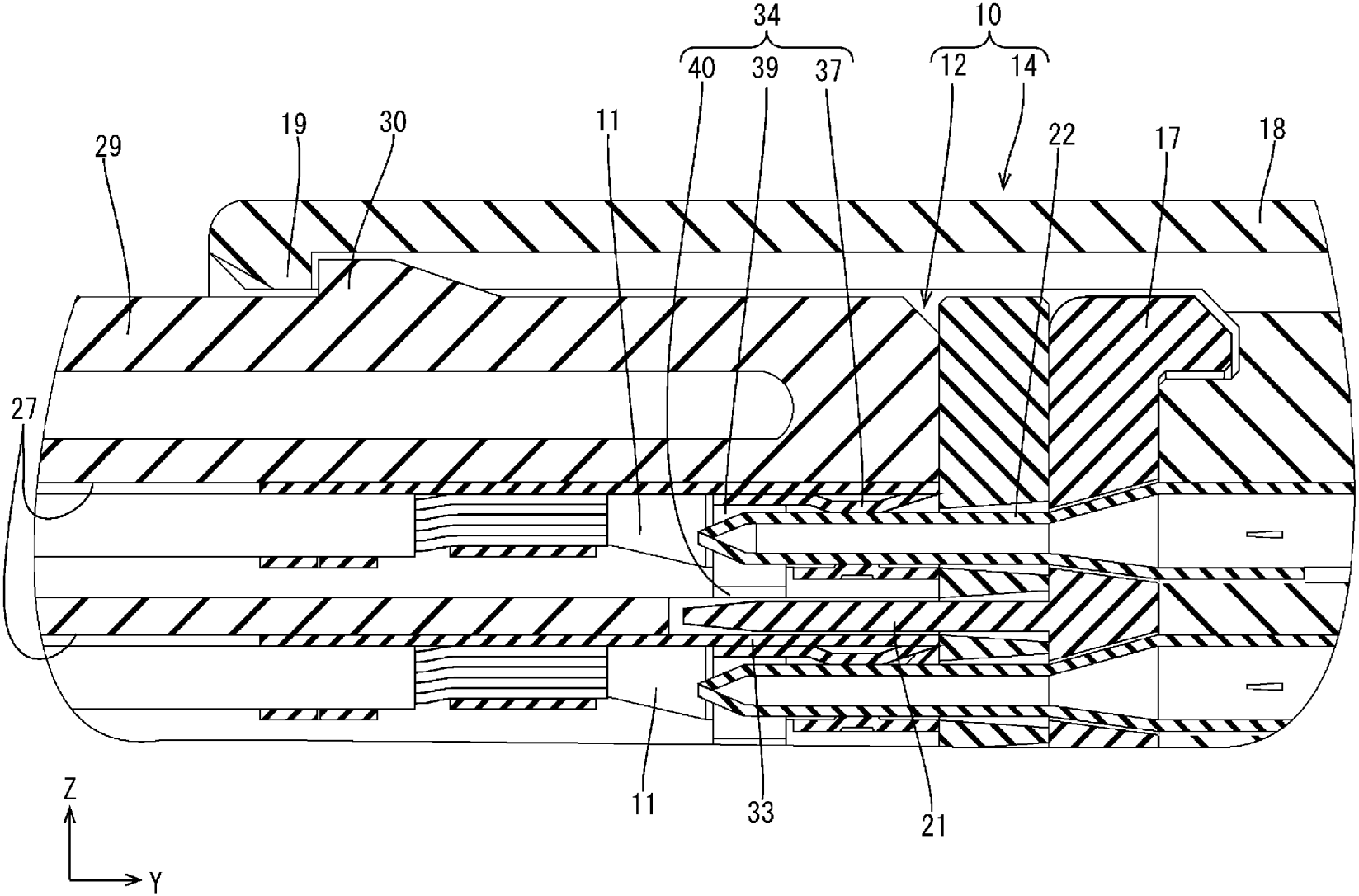
FIG. 8 is a partial enlarged section showing a state where the male connector and the female connector are connected.

When the female connector 12 is further pushed forward as shown in FIG. 8, the resilient pieces 34 are resiliently deformed to further move the inner contact points 37 upward. The outer contact points 40 further move upward. The insulating portions 21 are inserted between the outer contact points 40 and the tube portions 33 of the female terminals 11 located below and adjacent to the outer contact points 40. In this way, the outer contact points 40 and the female terminals 11 located below the outer contact points 40 are electrically insulated.

With the male tabs 22 inserted in the tube portions 33, the detour portions 39 are located to the left of the male tabs 22. In this way, the interference of the tips of the male tabs 22 and the resilient pieces 34 in the front-rear direction is avoided.

The lock arm 29 is restored and the lock claw 30 is engaged with the lock portion 19 from front, whereby the female connector 12 is held in the receptacle 18 of the male connector 14 while being prevented from coming out rearward. In this way, the connector assembly 10 is completed.

Functions and Effects of Embodiment

Next, functions and effects of this embodiment are described. The female terminal 11 according to this embodiment includes the tube portion 33, into which the male tab 22 of the male terminal 13 is inserted, and the resiliently deformable resilient piece 34 disposed in the tube portion 33, and the resilient piece 34 includes the inner contact point 37 located inside the tube portion 33 to contact the male tab 22 and the outer contact point 40 located outside the tube portion 33 to contact another one of the female terminals 11 arranged in the vertical direction.

Since the female terminal 11 can be electrically connected to the adjacent other female terminal 11 by the outer contact point 40, a shorting member is unnecessary. In this way, the number of components can be reduced.

The resilient piece 34 includes the detour portion 39 to be located lateral to the male tab 22 with the male tab 22 of the terminal inserted in the tube portion 33.

The outer contact point 40 can be led out to the outside of the tube portion 33 while the interference of the resilient piece 34 and the male tab 22 is avoided by the detour portion 39.

The female connector 12 according to the present disclosure includes the plurality of female terminals 11 and the female housing 26 having the plurality of female accommodating portions 27 for accommodating the plurality of female terminals 11, the plurality of female accommodating portions 27 are disposed side by side, the window portions 32 allowing communication between adjacent ones of the plurality of female accommodating portions 27 penetrate through the plurality of female accommodating portions 27, parts of the resilient pieces 34 including the outer contact points 40 penetrate through the window portions 32 with the plurality of female terminals 11 respectively accommodated in the plurality of accommodating portions, and one female terminal 11 and another female terminal 11 adjacent to the one female terminal 11 are electrically connected by the outer contact point 40 of the one female terminal 11, out of the plurality of female terminals 11.

Since the adjacent female terminals 11 are electrically connected to each other by the outer contact point 40 penetrating through the window portion 32, a shorting terminal is unnecessary, the female connector 12 can be reduced in size and the manufacturing cost of the female connector 12 can be reduced. Further, since it is not necessary to deform the shorting terminal, a connection force of the female connector 12 and the male connector 14 can be reduced.

The female terminal 11 includes the metal locking lance 25B projecting toward the female accommodating portion 27 to be engaged with the female accommodating portion 27.

Since the female accommodating portion 27 includes the window portion 32, there are possibly structural constraints in the case of providing a structure (e.g. resin locking lance) for holding the female terminal 11. Since the female accommodating portion 27 needs not be provided with a special structure for holding the female terminal 11 by the female terminal 11 including the metal locking lance 25B, a degree of freedom in designing the female connector 12 is improved.

The connector assembly 10 according to the present disclosure includes the female connector 12 and the male connector 14 to be connected to the female connector 12, the male terminals 13 are accommodated in the male connector 14, and the male tab 22 of the male terminal 13 contacts the inner contact point 37 of the resilient piece 34 to deform the resilient piece 34 with the female connector 12 and the male connector 14 connected, thereby releasing electrical connection between one female terminal 11 and another female terminal 11 adjacent to the one female terminal 11.

Since electrical connection between the adjacent female terminals 11 is released by the contact of the male tab 22 of the male terminal 13 with the inner contact point 37 of the female terminal 11, the number of components of the connector assembly 10 can be reduced as compared to the case where a releasing member is separately provided.

The male connector 14 includes the insulating portions 21 each having an insulating property and to be interposed between the outer contact point 40 of one female terminal 11 and the other female terminal 11 adjacent to the one female terminal 11 with the female connector 12 and the male connector 14 connected.

The adjacent female terminals 11 can be reliably insulated from each other by the insulating portions 21 with the female connector 12 and the male connector 14 connected.

Second Embodiment

Figure 9:
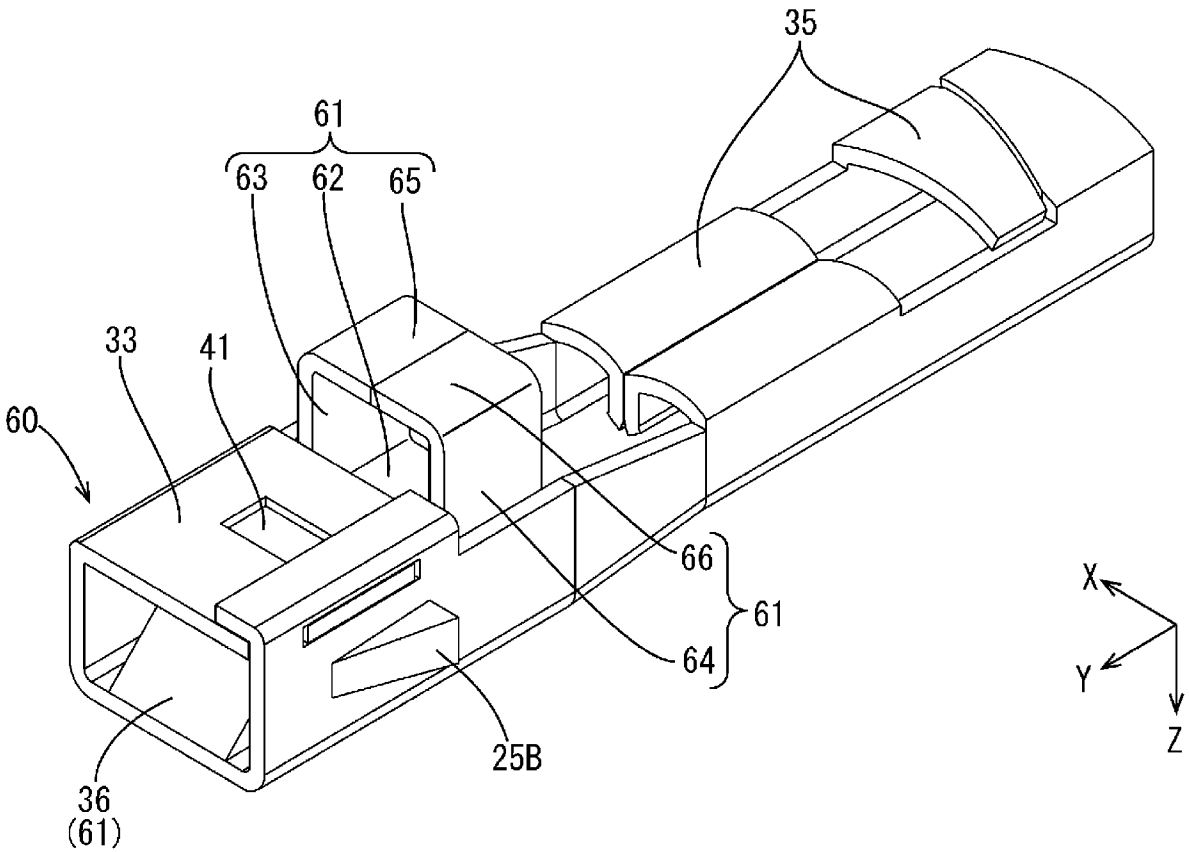
FIG. 9 is a perspective view showing a female terminal according to a second embodiment.
Figure 10:
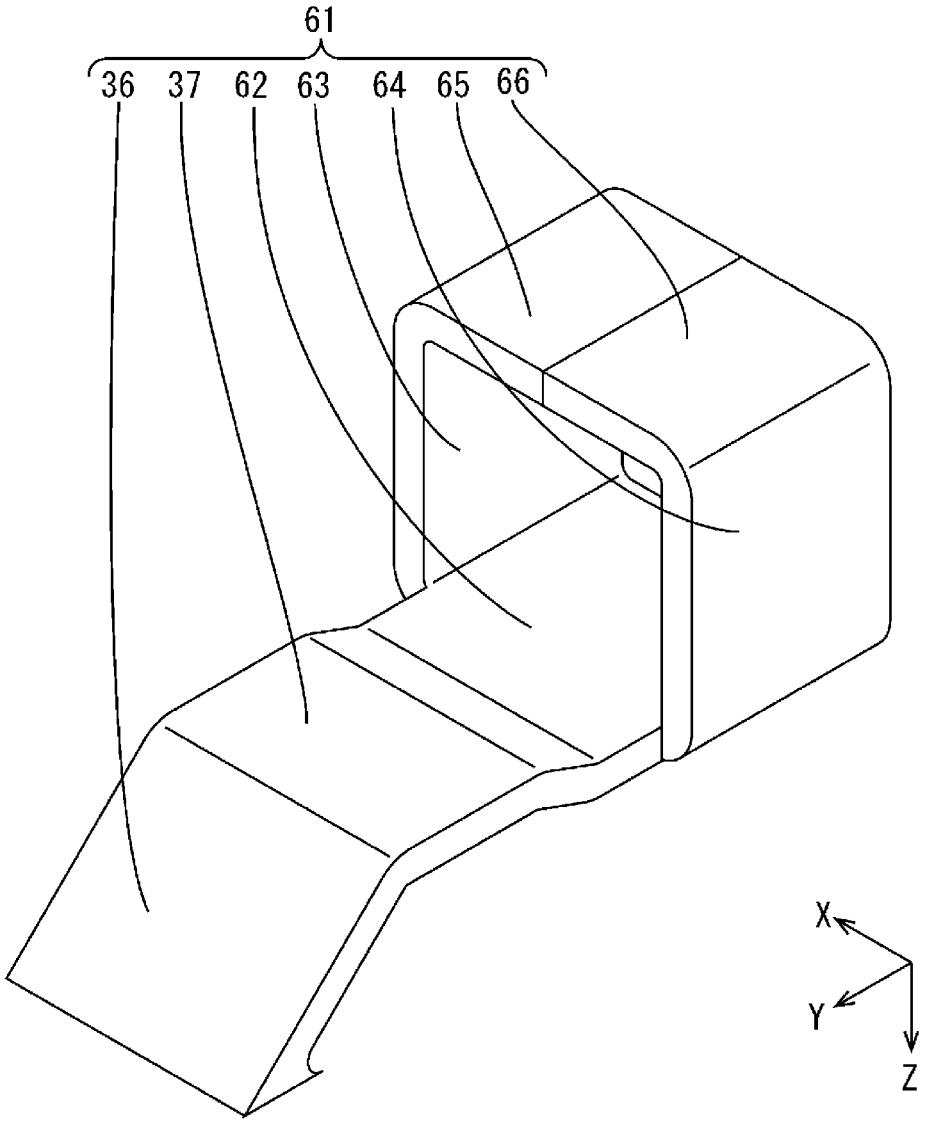
FIG. 10 is an enlarged view partially cut away showing a resilient piece.

Next, a female terminal 60 according to a second embodiment of the present disclosure is described with reference to FIGS. 9 and 10. A resilient piece 61 formed in the female terminal 60 of this embodiment includes a first detour portion 63 (an example of a detour portion) extending downward from the left side edge of an extending portion 62, a second detour portion 64 (an example of the detour portion) extending downward from the right side edge of the extending portion 62, a first outer contact point 65 (an example of an outer contact point) extending rightward from the lower end of the first detour portion 63 and a second outer contact point 66 (an example of the outer contact point) extending leftward from the lower end of the second detour portion 64. An end part of the first outer contact point 65 and that of the second outer contact point 66 are butted against each other in a lateral direction.

Widths in a front-rear direction of the first and second detour portions 63, 64 are set to be equal. Further, widths in the front-rear direction of the first and second outer contact points 65, 66 are also set to be equal. Setting to be equal means a case where the widths are set to be exactly equal and a case where the widths are not exactly equal, but can be acknowledge as equal.

With a male tab 22 inserted in a tube portion 33, the first detour portion 63 is located to the left of the male tab 22 and the second detour portion 64 is located to the right of the male tab 22. That is, the first and second detour portions 63, 64 are respectively located on both left and right sides of the male tab 22 with the male tab 22 inserted in the tube portion 33.

Since the configuration other than the above is substantially the same as in the first embodiment, the same members are denoted by the same reference signs and repeated description is omitted.

Since the first and second detour portions 63, 64 are respectively located on both left and right sides of the male tab 22 inserted in the tube portion 33, a load applied to an inner contact point 37 and a load applied to the first and second outer contact points 65, 66 can be equally received by the first and second detour portions 63, 64 located on both sides of the male tab 22. In this way, the electrical connection reliability of the inner contact point 37 and the first and second outer contact points 65, 66 is improved.

Third Embodiment

Figure 11:
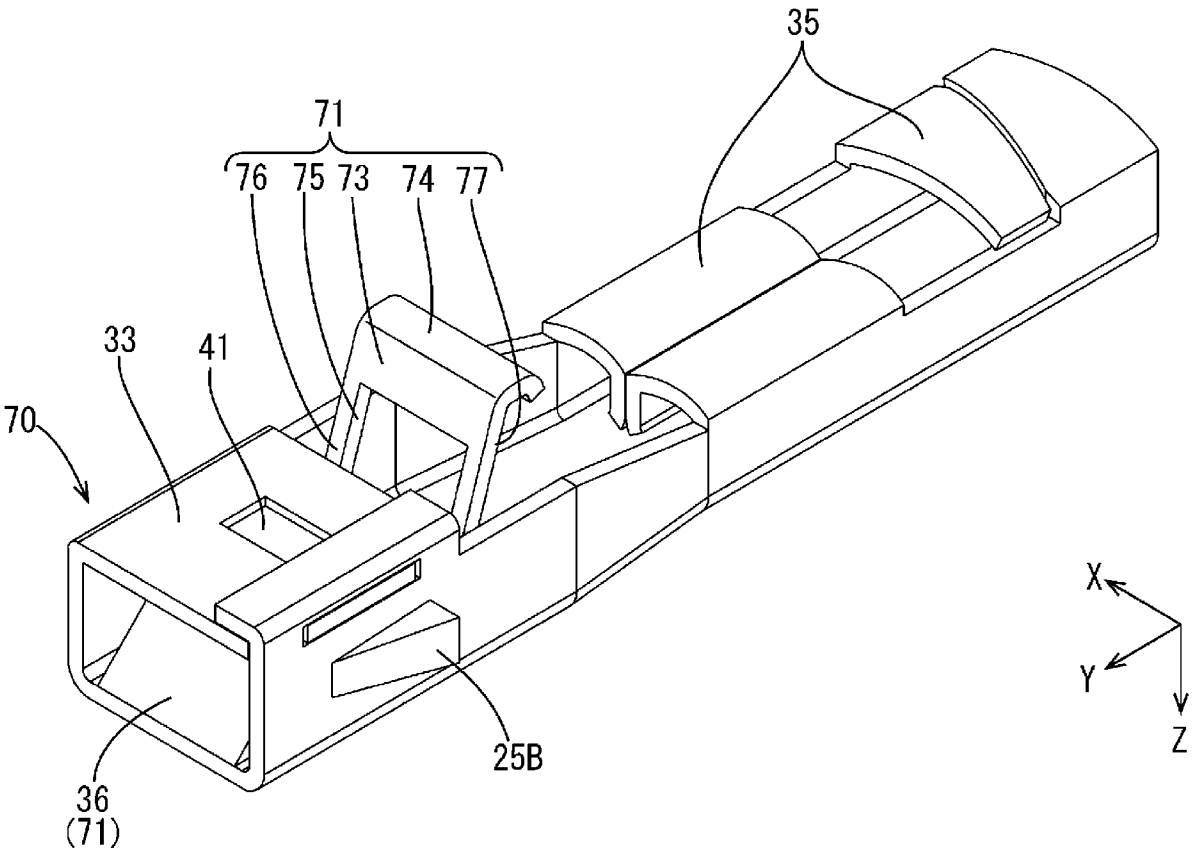
FIG. 11 is a perspective view showing a female terminal according to a third embodiment.
Figure 12:
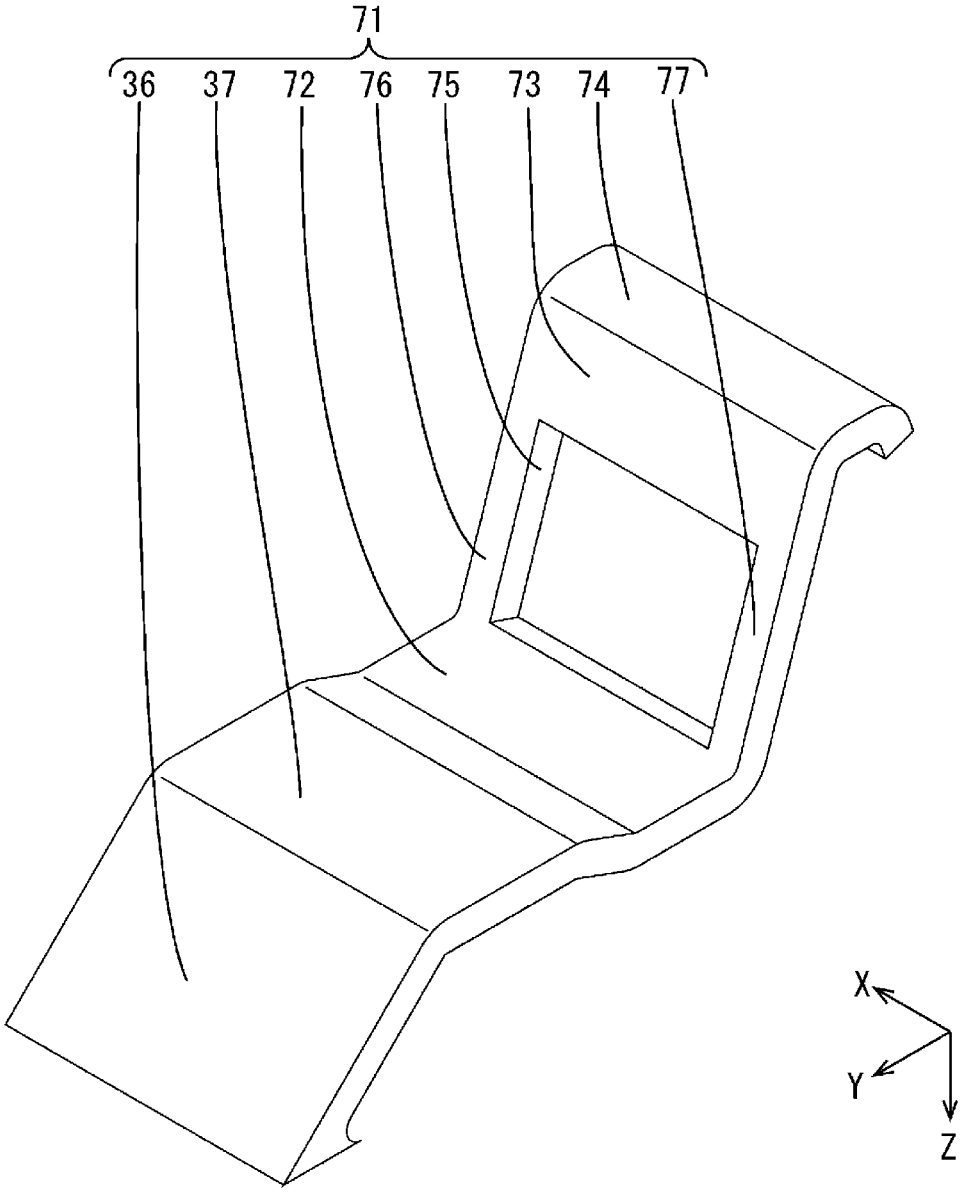
FIG. 12 is an enlarged view partially cut away showing a resilient piece.

Next, a female terminal 70 according to a third embodiment of the present disclosure is described with reference to FIGS. 11 and 12. A resilient piece 71 formed in the female terminal 70 of this embodiment includes a rising portion 73 rising obliquely toward an upper-rear side from the rear end edge of an extending portion 72 and an outer contact point 74 extending rearward from an upper end part of the rising portion 73.

The rising portion 73 is formed with a through hole 75 penetrating in the front-rear direction. A part of the rising portion 73 located to the left of the through hole 75 serves as a left detour portion 76 (an example of the detour portion) and a part thereof located to the right of the through hole 75 serves as a right detour portion 77 (an example of the detour portion).

With a male tab 22 inserted in a tube portion 33, the left and right detour portions 76, 77 are respectively located on both left and right sides of the male tab 22. In a lateral direction, a width of the left detour portion 76 and that of the right detour portion 77 are equal.

Since the configuration other than the above is substantially the same as in the first embodiment, the same members are denoted by the same reference signs and repeated description is omitted.

Since the left and right detour portions 76, 77 are respectively located on both left and right sides of the male tab 22 inserted in the tube portion 33, a load applied to an inner contact point 37 and a load applied to the outer contact point 74 can be equally received by the left and right detour portions 76, 77 located on both left and right sides of the male tab 22. In this way, the electrical connection reliability of the inner contact point 37 and the outer contact point 74 is improved.

Other Embodiments

The present disclosure is not limited to the above described and illustrated embodiments. For example, the following embodiments are also included in the technical scope of the technique disclosed in this specification.

(1) The female terminals may be arranged in an arbitrary direction such as the lateral direction.

(2) The resilient piece may be separate from the tube portion. The resilient piece may be folded forward from the rear end part of the tube portion. The resilient piece may extend in the lateral direction from the front or rear end part of the tube portion. The resilient piece may extend inwardly of the tube portion from an intermediate position in the front-rear direction of the tube portion.

(3) The female housing 26 may include resin locking lances projecting inward from the inner walls of the female accommodating portions 27 for retaining and holding the female terminals 11.

(4) The outer contact point of the female terminal may electrically connect the female terminal to a conductor different from the adjacent female terminal.

(5) The insulating portions 21 may be omitted.

(6) If the resilient piece 34 extends up to a position avoiding the tip of the male tab 22 with the male tab 22 inserted in the tube portion 33, the detour portion may be omitted.

(7) The metal locking lance 25B may be engaged with a wall formed with the window portion 32, out of the female accommodating portion 27.

LIST OF REFERENCE NUMERALS

10: connector assembly
11, 60, 70: female terminal
12: female connector
13: male terminal
14: male connector
15: male housing
16: male accommodating portion
17: male front mask
18: receptacle
19: lock portion
20: male through hole
21: insulating portion
22: male tab
23: male barrel
24A, 24B: wire
25A, 25B: metal locking lance
26: female housing
27: female accommodating portion
28: female front mask
29: lock arm
30: lock claw
31: female through hole
32: window portion
33: tube portion
34, 61, 71: resilient piece
35: female barrel
36: inclined portion
37: inner contact point
38, 62, 72: extending portion
39: detour portion
40, 74: outer contact point
41: contact protrusion
42: carrier
43: part to be processed into female barrel
44: part to be processed into tube portion
45: part to be processed into resilient piece
46: part to be processed into inclined portion
47: part to be processed into inner contact point
48: part to be processed into extending portion
49: part to be processed into detour portion
50: part to be processed into outer contact point
63: first detour portion
64: second detour portion
65: first outer contact point
66: second outer contact point
73: rising portion
75: through hole
76: left detour portion
77: right detour portion

What is claimed is:

1. A terminal, comprising:

a tube portion, a mating terminal being inserted into the tube portion, and a resiliently deformable resilient piece disposed in the tube portion, wherein the resilient piece includes an inner contact point located inside the tube portion to contact the mating terminal, at least one detour portion extending downward from a side edge of the resilient piece, and an outer contact point extending from a lower end of the detour portion, and wherein the outer contact point is located outside the tube portion to contact a conductor different from the mating terminal.

2. The terminal of claim 1, wherein the at least one detour portion is located lateral to the mating terminal with the mating terminal inserted in the tube portion.

3. The terminal of claim 2, wherein a pair of the detour portions are disposed on both sides of the mating terminal inserted in the tube portion.

4. A connector, comprising:

the terminal of claim 1; and a housing including a plurality of accommodating portions for accommodating the terminal, wherein:

the plurality of accommodating portions are disposed side by side and window portions allowing communication between adjacent ones of the plurality of accommodating portions penetrate through the plurality of accommodating portions, a part of the resilient piece including the outer contact point penetrates through the window portion with the terminal accommodated in each of the plurality of accommodating portions, and one terminal and another terminal adjacent to the one terminal are electrically connected by the outer contact point of the one terminal, out of a plurality of the terminals.

5. The connector of claim 4, wherein the terminal includes a metal locking lance projecting toward the accommodating portion to be engaged with the accommodating portion.

6. A connector assembly, comprising:

the connector of claim 4; and a mating connector to be connected to the connector, wherein:

the mating terminal is accommodated in the mating connector, and the mating terminal releases electrical connection between the one terminal and the other terminal adjacent to the one terminal by contacting the inner contact point of the resilient piece to deform the resilient piece with the connector and the mating connector connected.

7. The connector assembly of claim 6, wherein the mating connector includes an insulating portion having an insulating property and to be interposed between the outer contact point of the one terminal and the other terminal adjacent to the one terminal with the connector and the mating connector connected.

* * * * *